US012082658B1

(12) United States Patent
Qiu

(10) Patent No.: US 12,082,658 B1
(45) Date of Patent: Sep. 10, 2024

(54) INTEGRATED QUICK RELEASE STRAP BUCKLE

(71) Applicant: Bicheng Qiu, Meizhou (CN)

(72) Inventor: Bicheng Qiu, Meizhou (CN)

( * ) Notice: Subject to any disclaimer, the term of this patent is extended or adjusted under 35 U.S.C. 154(b) by 0 days.

(21) Appl. No.: 18/536,399

(22) Filed: Dec. 12, 2023

(30) Foreign Application Priority Data

Nov. 10, 2023 (CN) ..... 202323034997.6

(51) Int. Cl.
*A44B 11/25* (2006.01)

(52) U.S. Cl.
CPC ..... *A44B 11/2584* (2013.01)

(58) Field of Classification Search
CPC ..... A44B 11/2584
See application file for complete search history.

(56) References Cited

U.S. PATENT DOCUMENTS 6,233,788 B1 * 5/2001 Choy ..... A45F 5/02 24/669
6,695,269 B1 * 2/2004 Anscher ..... A45C 13/30 248/225.11
9,247,787 B2 * 2/2016 Dering ..... A44B 11/25
10,772,387 B2 * 9/2020 Lee ..... A44B 11/00
2001/0042273 A1 * 11/2001 Chaffee ..... A44B 11/2584 5/655.3
2022/0011654 A1 * 1/2022 Ruckman ..... G03B 17/561

* cited by examiner

*Primary Examiner* — Robert Sandy
(74) *Attorney, Agent, or Firm* — Birchwood IP

(57) ABSTRACT

An integrated quick release strap buckle is provided, which includes a clamping mechanism and a connecting mechanism. The connecting mechanism is provided in the clamping mechanism, the connecting mechanism is placed in a first groove of a block, the connecting mechanism being pushed towards an interior of a second groove, and at the same time, a plate is driven to move downwards by the connecting mechanism. When the connecting mechanism fully enters the second groove, a drive on the plate is released, due to an elasticity of the plate, it moves upwards and compresses the connecting mechanism to complete an engagement between the connecting mechanism and the block. The connecting mechanism is compressed through an integrated plate that is provided in the block, an integrated type has less wear and a longer service life.

6 Claims, 6 Drawing Sheets

INTEGRATED QUICK RELEASE STRAP BUCKLE

CROSS-REFERENCE TO RELATED APPLICATIONS

This application claims priority to Chinese Patent Application No. 202323034997.6, filed on Nov. 10, 2023, which is hereby incorporated by reference in its entirety.

TECHNICAL FIELD

The present disclosure relates to the field of strap buckle technologies, and in particular, to an integrated quick release strap buckle.

BACKGROUND

Integrated quick release strap buckle is a convenient and fast strap buckle, its main characteristics are quick release and installing the strap, which renders it to be very convenient to use. This type of strap buckle usually consists of two parts, one fixed to a backpack body and the other fixed to the strap, they are connected by a special mechanical structure for quick release and installation.

The existing quick release buckle is mainly composed of arc-shaped blocks, connection blocks, and spring plates. The connection blocks are compressed by the spring plates arranged in the arc-shaped blocks to achieve an effect of clamping. However, the spring plates arranged in the arc-shaped blocks are prone to wear after a period of use, which causes a decrease in the elasticity of the spring plates and reducing the service life.

Therefore, it is necessary to provide a new integrated quick release strap buckle to solve the above-mentioned technical problems.

SUMMARY

To solve the above technical problems, the present disclosure provides an integrated quick release strap buckle.

The present disclosure provides an integrated quick release strap buckle including a clamping mechanism and a connecting mechanism, the connecting mechanism is movably provided in the clamping mechanism;

the clamping mechanism includes a block, a plate, and a support component; one side of the block is provided with a first groove, the plate is provided in the first groove; two sides of one end of the plate are respectively fixedly connected to two sides of an interior of the first groove, and the plate is elastic; an inner side wall of one side of the first groove extends outwardly so as to form a second groove, one end of the plate extends to an interior of the second groove, an outer surface of the plate is movably connected to an inner surface of the second groove; a top end of the support component is fixedly connected to a bottom of the plate; the connecting mechanism is movably provided in the second groove; a bottom of the connecting mechanism is movably connected to a top end of the plate.

In an embodiment of the present disclosure, the support component includes a support block, a support plate, a connector, and a fastener; a bottom of the support plate is fixedly connected to a top end of the support block; a bottom of the block is provided with a support groove; a top end of the support plate extends to an interior of the support groove and is movably connected to the support groove; one side of the support block is provided with a movable groove; the outer surface of the plate is movably connected to an inner surface of the movable groove; a bottom of the fastener is fixedly connected to the top end of the support block; a top end of the connector is fixedly connected to the bottom of the block; a top end of the fastener extends to an interior of the connector and is movably connected to the connector.

In an embodiment of the present disclosure, the fastener includes multiple fix columns, which are provided around an inner edge of the support block, bottoms of the multiple fix columns are respectively fixedly connected to the top end of the support block, and top ends of the multiple fix columns respectively extend to the interior of the connector and are movably connected to the connector.

In an embodiment of the present disclosure, the connector includes multiple connection columns, the multiple connection columns are provided around an inner edge of the block, top ends of the multiple connection columns are respectively fixedly connected to the bottom of the block, and top ends of the multiple fix columns respectively extend to interiors of the multiple connection columns and are movably connected to the multiple connection columns.

In an embodiment of the present disclosure, the connecting mechanism includes a connection block, an octagonal block, and a transmission component; the connection block is movably provided in the second groove, a bottom of the octagonal block is fixedly connected to a top end of the connection block, a top end of the octagonal block extends out of the second groove, an outer surface of the octagonal block is movably connected to the interior of the second groove, one side wall of one side of the second groove away from the first groove is provided with a square groove; one end of the transmission component is fixedly connected to one end of the connection block away from the first groove, one end of the transmission component away from the connection block passes through the second groove and extends out of the square groove, an outer surface of the transmission component is movably connected to inner surfaces of the second groove and the square groove, respectively.

In an embodiment of the present disclosure, the transmission component includes a conical rope, one end of the conical rope is fixedly connected to one end of the connection block away from the first groove, and one end of the conical rope away from the connection block passes through the second groove and extends out of the square groove, an outer surface of the conical rope is moveably connected to inner surfaces of the second groove and the square groove, respectively.

Compared with related technologies, the integrated quick release strap buckle provided by the present disclosure has the following beneficial effects:

the connecting mechanism is placed in the first groove of the block, the connecting mechanism is pushed towards the interior of the second groove, and at the same time, the plate is driven to move downwards by the connecting mechanism. When the connecting mechanism fully enters the second groove, a drive on the plate is released. Due to the elasticity of the plate, the plate moves upwards and compresses the connecting mechanism to complete an engagement between the connecting mechanism and the block. By using an integrated plate placed in the block to compress the connecting mechanism, compared to the existing mode of sleeving a spring plate in the block, an integrated type has less wear and a longer service life.

Numeral reference: 1. block; 2. plate; 3. first groove; 4. second groove; 5. support block; 6. support plate; 7. support groove; 8. movable groove; 9. fix column; 10. connection column; 11. connection block; 12. octagonal block; 13. conical rope; 14. square groove.

DESCRIPTION OF EMBODIMENTS

The following will provide a further explanation of the present disclosure in combination with the drawings and implementation modes.

Figure 1:
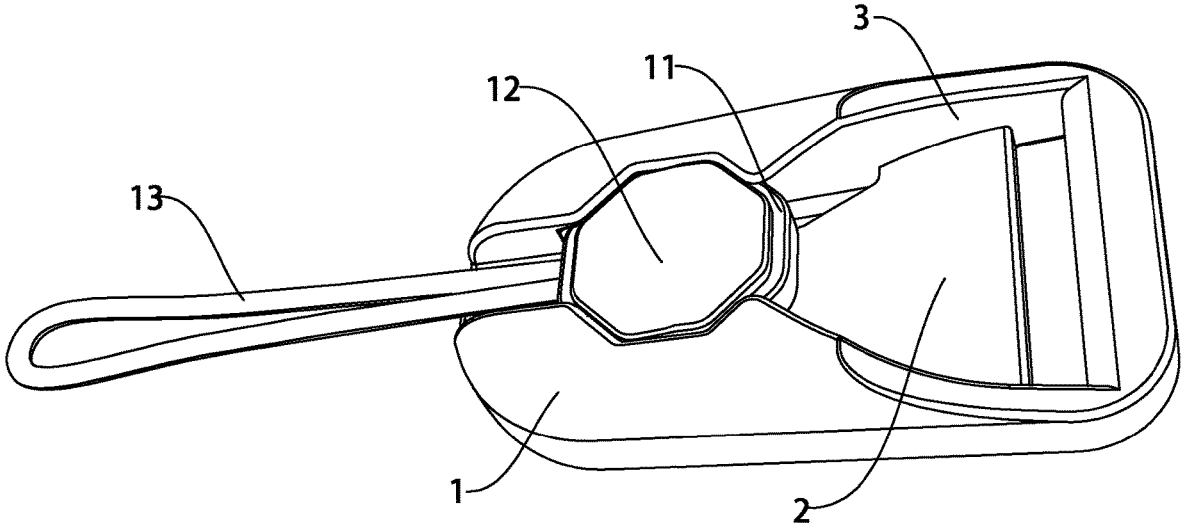
FIG. 1 is a first schematic diagram of an overall structure of an integrated quick release strap buckle provided by the present disclosure.
Figure 2:
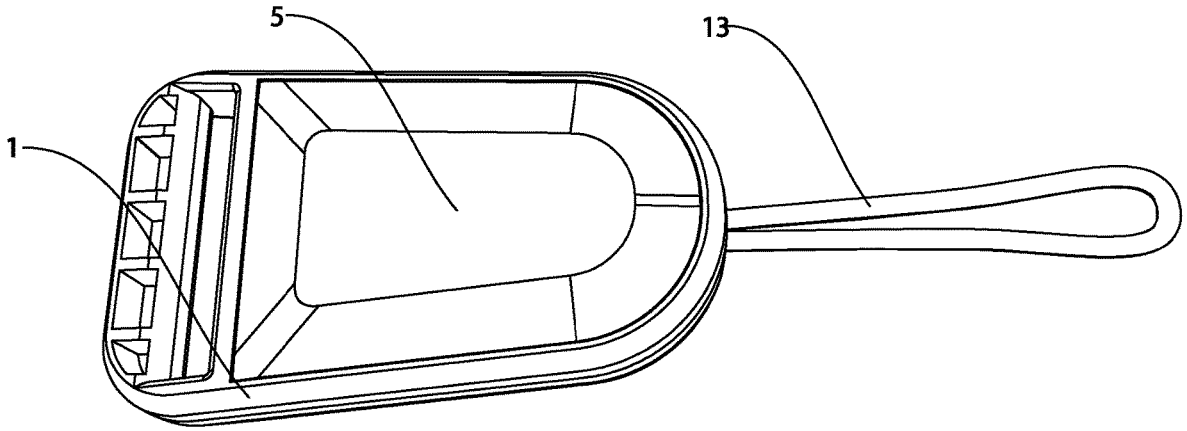
FIG. 2 is a second schematic diagram of the overall structure of the integrated quick release strap buckle provided by the present disclosure.
Figure 3:
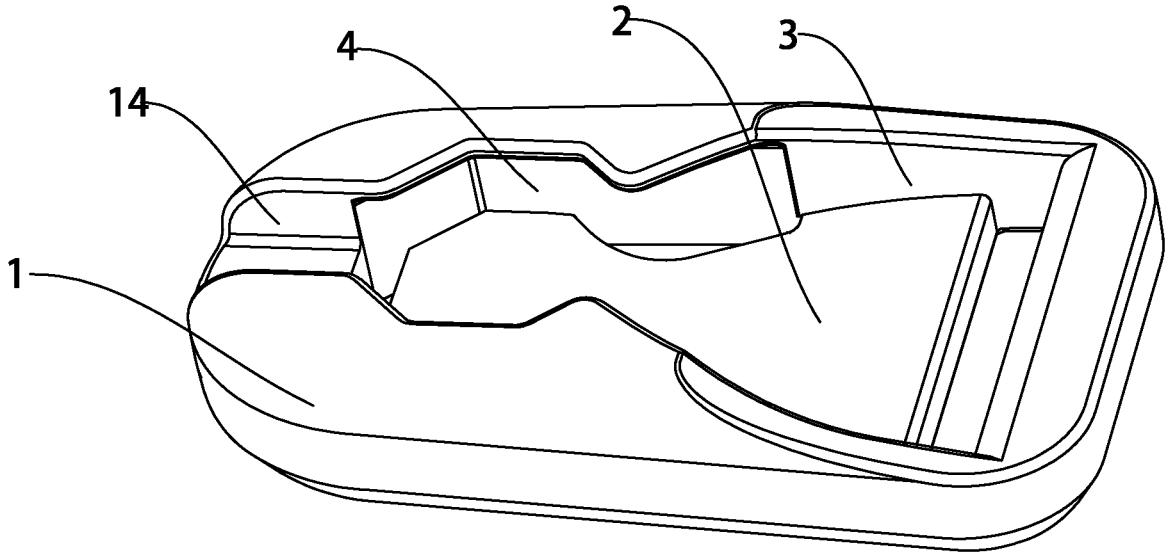
FIG. 3 is a schematic diagram of a local structure shown in FIG. 1.
Figure 4:
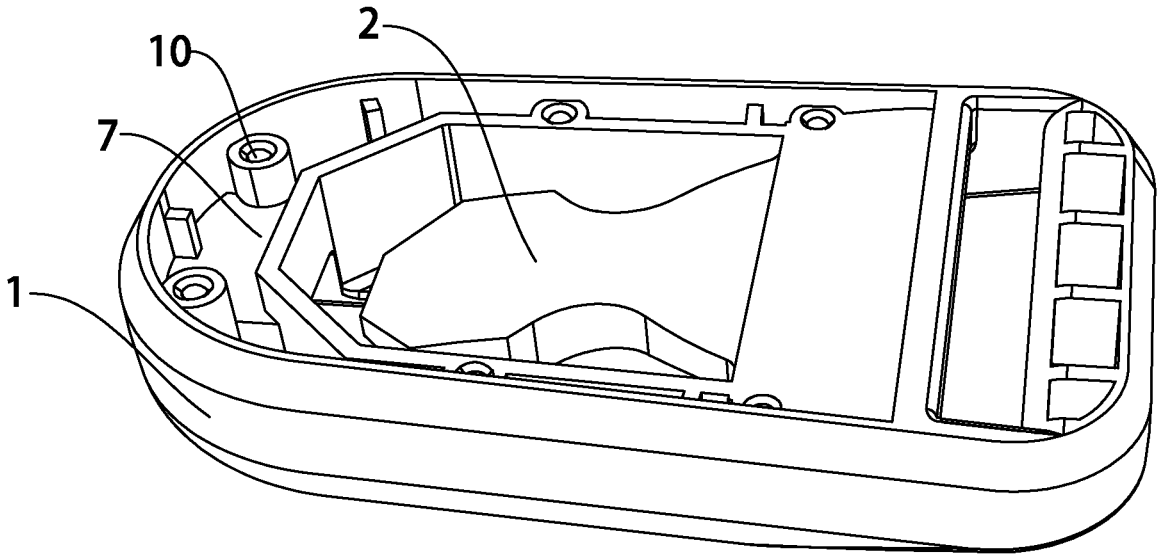
FIG. 4 is a schematic diagram of a local structure shown in FIG. 2.
Figure 5:
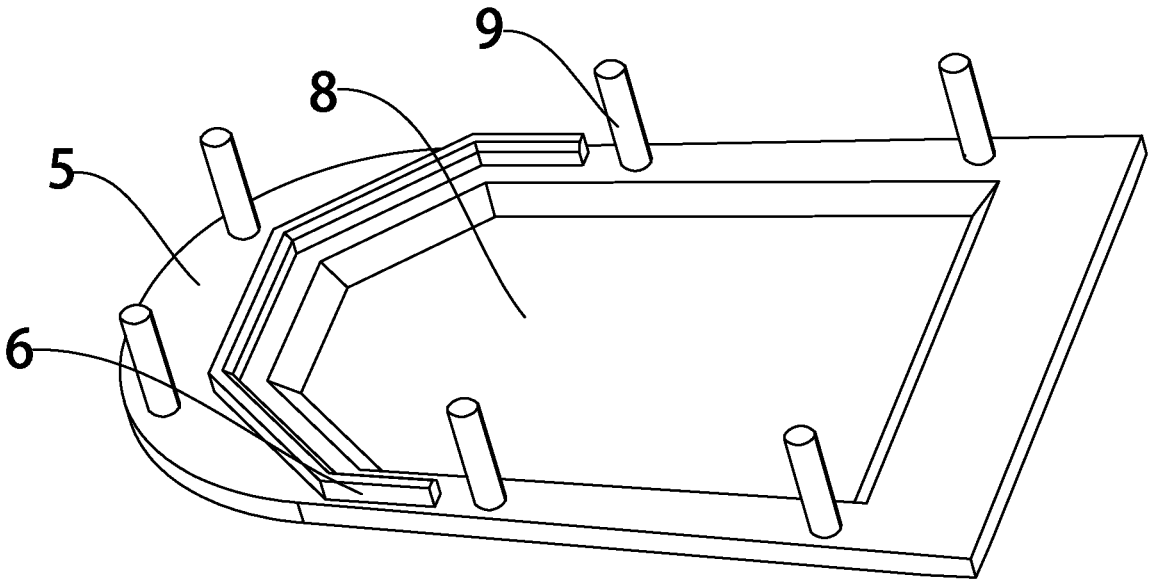
FIG. 5 is a structural schematic diagram of a support component shown in FIG. 2.
Figure 6:
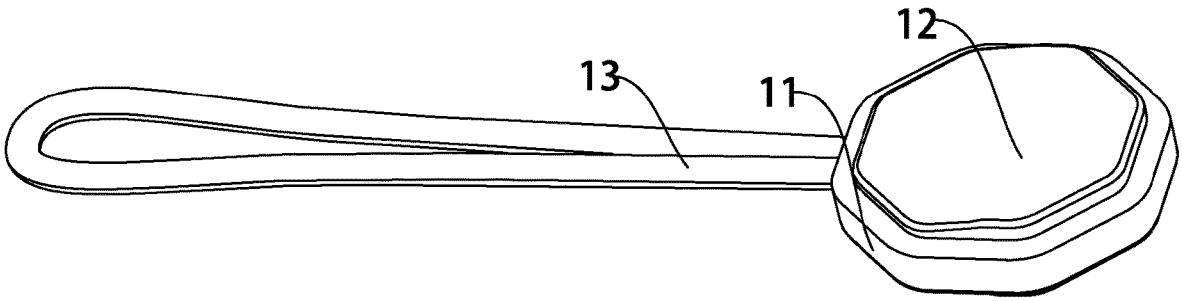
FIG. 6 is a structural schematic diagram of a connecting mechanism shown in FIG. 1.

Please refer to FIGS. 1-6, FIG. 1 is a first schematic diagram of an overall structure of an integrated quick release strap buckle provided by the present disclosure; FIG. 2 is a second schematic diagram of the overall structure of the integrated quick release strap buckle provided by the present disclosure; FIG. 3 is a schematic diagram of a local structure shown in FIG. 1; FIG. 4 is a schematic diagram of a local structure shown in FIG. 2; FIG. 5 is a structural schematic diagram of a support component shown in FIG. 2; FIG. 6 is a structural schematic diagram of a connecting mechanism shown in FIG. 1.

In a specific implementation process, as shown in FIGS. 1-6, the integrated quick release strap buckle includes a clamping mechanism and a connecting mechanism. The connecting mechanism is movably provided in the clamping mechanism, the clamping mechanism includes a block 1, a plate 2, and a support component. One side of the block 1 is provided with a first groove 3, the plate 2 is provided in the first groove 3. Two sides of one end of the plate 2 are respectively fixedly connected to two sides of an interior of the first groove 3, and the plate 2 is elastic, an inner side wall of one side of the first groove 3 extends outwardly so as to form a second groove 4. One end of the plate 2 extends to an interior of the second groove 4, an outer surface of the plate 2 is movably connected to an inner surface of the second groove 4. A top end of the support component is fixedly connected to a bottom of the plate 2, the connecting mechanism is movably provided in the second groove 4. A bottom of the connecting mechanism is movably connected to a top end of the plate 2. The support component includes a support block 5, a support plate 6, a connector, and a fastener. A bottom of the support plate 6 is fixedly connected to a top end of the support block 5. A bottom of the block 1 is provided with a support groove 7; a top end of the support plate 6 extends to an interior of the support groove 7 and is movably connected to the support groove 7. One side of the support block 5 is provided with a movable groove 8; the outer surface of the plate 2 is movably connected to an inner surface of the movable groove 8. A bottom of the fastener is fixedly connected to the top end of the support block 5; a top end of the connector is fixedly connected to the bottom of the block 1, a top end of the fastener extends to an interior of the connector and is movably connected to the connector. The fastener includes multiple fix columns 9, which are respectively provided around an inner edge of the support block 5. Bottoms of the multiple fix columns 9 are respectively fixedly connected to the top end of the support block 5, and top ends of the multiple fix columns 9 respectively extend to the interior of the connector and are movably connected to the connector. The connector includes multiple connection columns 10, which are respectively provided around an inner edge of the block 1, top ends of the multiple connection columns 10 are respectively fixedly connected to the bottom of the block 1, and top ends of the multiple fix columns 9 respectively extend to interiors of the multiple connection columns 10 and are movably connected to the multiple connection columns 10. The connecting mechanism includes a connection block 11, an octagonal block 12, and a transmission component. The connection block 11 is movably provided in the second groove 4, a bottom of octagonal block 12 is fixedly connected to a top end of the connection block 11. A top end of the octagonal block 12 extends out of the second groove 4, an outer surface of the octagonal block 12 is movably connected to the interior of the second groove 4, one side wall of one side of the second groove 4 away from the first groove 3 is provided with a square groove 14. One end of the transmission component is fixedly connected to one end of the connection block 11 away from the first groove 3. One end of the transmission component away from the connection block 11 passes through the second groove 4 and extends out of the square groove 14. An outer surface of the transmission component is movably connected to inner surfaces of the second groove 4 and the square groove 14, respectively. The transmission component includes a conical rope 13, one end of the conical rope 13 is fixedly connected to one end of the connection block 11 away from the first groove 3, and one end of the conical rope 13 away from the connection block 11 passes through the second groove 4 and extends out of the square groove 14. An outer surface of the conical rope 13 is movably connected to inner surfaces of the second groove 4 and the square groove 14, respectively. The support block 5 is pushed towards the block 1 by a staff, the fixing of the support block 5 to the connection column 10 is driven, and at the same time, the support plate 6 enters into the support groove 7 of the block 1, an installation of the support block 5 and the block 1 is completed. By using this structure, a bending range of the plate 2 is limited to prevent it from breaking due to an excessive bending. At the same time, when the plate 2 is move downwards driven by the connection block 11, the plate 2 is driven to enter into the movable groove 8 of the support block 5. By allowing the plate 2 to enter into the movable groove 8, the bending range of the plate 2 is increased so as to ensure that the connection block 11 can enter into the second groove 4 normally.

The working principle provided by the present disclosure is as follows: the connection block 11 is placed in the first groove 3 of the block 1, the connection block 11 is pushed towards the interior of the second groove 4, and at the same time, the plate 2 is driven to move downwards. When the connection block 11 completely enters into the second groove 4, a drive force on the plate 2 will be released. Due to the elasticity of the plate 2, the plate 2 moves upwards and compresses the connection block 11, the second groove 4 is driven to extend out of the second groove 4 through the connection block 11, thereby completing an engagement of the connection block 11 with the block 1.

The circuits and controls involved in the present disclosure are all prior art and will not be further elaborated here.

The above is only an embodiment of the present disclosure and does not limit the scope of the present disclosure. Any equivalent structure or equivalent process changes made using the description and drawings of the present disclosure, or directly or indirectly applied in other related technical fields, are also included in the protection scope of the present disclosure.

What is claimed is:

1. An integrated quick release strap buckle, comprising:

a clamping mechanism and a connecting mechanism, wherein the connecting mechanism is provided in the clamping mechanism;

the clamping mechanism comprises a block (1), a plate (2), and a support component; one side of the block (1) is provided with a first groove (3), the plate (2) is provided in the first groove (3); two sides of one end of the plate (2) are respectively fixedly connected to two sides of an interior of the first groove (3), and the plate (2) is elastic;

an inner side wall of one side of the first groove (3) extends outwardly so as to form a second groove (4); one end of the plate (2) extends to an interior of the second groove (4), an outer surface of the plate (2) is connected to an inner surface of the second groove (4); a top of the support component is fixedly connected to a bottom of the plate (2); the connecting mechanism is provided in the second groove (4); a bottom of the connecting mechanism is connected to a top of the plate (2).

2. The integrated quick release strap buckle according to claim 1, wherein the support component comprises a support block (5), a support plate (6), a connector, and a fastener; a bottom of the support plate (6) is fixedly connected to a top of the support block (5); a bottom of the block (1) is provided with a support groove (7); a top of the support plate (6) extends to an interior of the support groove (7) and is connected to the support groove (7); one side of the support block (5) is provided with a hexagonal groove (8); the outer surface of the plate (2) is connected to an inner surface of the hexagonal groove (8); a bottom of the fastener is fixedly connected to the top of the support block (5); a top of the connector is fixedly connected to the bottom of the block (1); a top of the fastener extends to an interior of the connector and is connected to the connector.

3. The integrated quick release strap buckle according to claim 2, wherein the fastener comprises multiple fix columns (9), which are provided around an inner edge of the support block (5), bottoms of the multiple fix columns (9) are respectively fixedly connected to the top of the support block (5), and tops of the multiple fix columns (9) respectively extend to the interior of the connector and are connected to the connector.

4. The integrated quick release strap buckle according to claim 3, wherein the connector comprises multiple connection columns (10), the multiple connection columns (10) are provided around an inner edge of the block (1), tops of the multiple connection columns (10) are respectively fixedly connected to the bottom of the block (1), and tops of the multiple fix columns (9) respectively extend to interiors of multiple connection columns (10) and are connected to the multiple connection columns (10).

5. The integrated quick release strap buckle according to claim 4, wherein the connecting mechanism comprises a connection block (11), an octagonal block (12), and a transmission component; the connection block (11) is provided in the second groove (4), a bottom of the octagonal block (12) is fixedly connected to a top of the connection block (11), a top of the octagonal block (12) extends out of the second groove (4), an outer surface of the octagonal block (12) is connected to the interior of the second groove (4), one side wall of one side of the second groove (4) away from the first groove (3) is provided with a square groove (14); one end of the transmission component is fixedly connected to one end of the connection block (11) away from the first groove (3), one end of the transmission component away from the connection block (11) passes through the second groove (4) and extends out of the square groove (14), an outer surface of the transmission component is connected to inner surfaces of the second groove (4) and the square groove (14), respectively.

6. The integrated quick release strap buckle according to claim 5, wherein the transmission component comprises a conical rope (13), wherein one end of the conical rope (13) is fixedly connected to one end of the connection block (11) away from the first groove (3), and one end of the conical rope (13) away from the connection block (11) passes through the second groove (4) and extends out of the square groove (14), an outer surface of the conical rope (13) is connected to inner surfaces of the second groove (4) and the square groove (14), respectively.

* * * * *